US011073007B2

(12) United States Patent
Jamison

(10) Patent No.: US 11,073,007 B2
(45) Date of Patent: Jul. 27, 2021

(54) METHODS TO PERFORM WELLBORE STRENGTHENING, METHODS TO PULSE HYDRAULIC FRACTURE A DOWNHOLE FORMATION, AND WELLBORE STRENGTHENING SYSTEMS

(71) Applicant: Halliburton Energy Services, Inc., Houston, TX (US)

(72) Inventor: Dale E. Jamison, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 21 days.

(21) Appl. No.: 16/671,085

(22) Filed: Oct. 31, 2019

(65) Prior Publication Data

US 2021/0131246 A1 May 6, 2021

(51) Int. Cl.

| | |
|---|---|
| ***E21B 43/26*** | (2006.01) |
| ***E21B 47/00*** | (2012.01) |
| ***E21B 33/127*** | (2006.01) |
| ***E21B 21/00*** | (2006.01) |
| ***E21B 33/138*** | (2006.01) |
| *E21B 47/12* | (2012.01) |

(52) U.S. Cl.

CPC ..... *E21B 43/26* (2013.01); *E21B 21/003* (2013.01); *E21B 33/127* (2013.01); *E21B 33/138* (2013.01); *E21B 47/00* (2013.01); *E21B 47/12* (2013.01)

(58) Field of Classification Search

CPC .... E21B 21/003; E21B 33/127; E21B 33/138; E21B 43/26; E21B 47/00; E21B 47/12

See application file for complete search history.

(56) References Cited

U.S. PATENT DOCUMENTS 9,016,391 B1 * 4/2015 Chauffe ..... E21B 33/12 166/387
9,611,724 B2 4/2017 Hunter et al.
9,683,424 B2 6/2017 Cleven
(Continued)

FOREIGN PATENT DOCUMENTS

CN 104929605 B 6/2014

OTHER PUBLICATIONS

M. Reza Safari, et al.; "Pulsed Fracturing in Shale Reservoirs: Geomechanical Aspects, Ductile-Brittle Transition and Field Implications"; Unconventional Resources Technology Conference (URTeC); Aug. 12-14, 2013; SPE 168759 / URTeC 1579760.
(Continued)

*Primary Examiner* — Christopher J Sebesta
(74) *Attorney, Agent, or Firm* — McGuireWoods LLP

(57) ABSTRACT

Methods to perform wellbore strengthening, methods to pulse hydraulic fracture a downhole formation, and wellbore strengthening systems are disclosed. A method to perform wellbore strengthening includes deploying an annular isolation device in a wellbore of a well. The method also includes pumping a fluid carrying a loss circulation material through a conveyance into a zone of an annular region of a wellbore. The method further includes activating the annular isolation device to reduce fluid flow in the zone. The method further includes generating a hydraulic pulse to form one or more fractures. The method further includes injecting a loss circulation material into the one or more fractures.

17 Claims, 6 Drawing Sheets

(56) References Cited

U.S. PATENT DOCUMENTS

| | | | | |
|---|---|---|---|---|
| 2008/0128130 | A1 | 6/2008 | Whitsitt et al. | |
| 2009/0178801 | A1* | 7/2009 | Nguyen | E21B 43/00 166/249 |
| 2010/0122821 | A1* | 5/2010 | Corre | E21B 33/1216 166/387 |
| 2013/0292119 | A1* | 11/2013 | Hilliard | E21B 33/129 166/285 |
| 2015/0176376 | A1* | 6/2015 | Gisolf | E21B 47/06 166/250.01 |
| 2015/0240588 | A1* | 8/2015 | Freeman | E21B 33/1277 166/179 |
| 2016/0186529 | A1* | 6/2016 | Hunter | E21B 43/003 166/308.1 |
| 2019/0249512 | A1* | 8/2019 | Foster | E21B 33/1216 |

OTHER PUBLICATIONS

Sau-Wai Wong, et al.; "Pulsed Water Injection During Waterflooding"; Society of Petroleum Engineers; SPE 84856; Oct. 2003; 16 pages.

Khalid Alruwalli, et al.; "Large-Scale Chemically Pulsed Fracturing Stimulation of Unconventional Reservoir Using Hybrid FEM-DEM Approach"; Society of Petroleum Engineers; Mar. 18-21, 2019; SPE-194728-MS.

International Search Report and Written Opinion issue in corresponding International Patent Application No. PCT/US2019/059700; dated Jul. 28, 2020.

* cited by examiner

400

3S
1S
0.5S
410
408
406
404
403
402
PEAK ECD, LB/GAL
SPP, PSI
FLOW RATE, GPM
25.0
20.0
15.0
10.0
5.0
0.0
5000
4500
4000
3500
3000
2500
2000
1500
1000
500
0
0
100
200
300
400
500
600
700
800
900
1000

500

3S
1S
0.5S
510
508
506
504
503
502
PEAK ECD, LB/GAL
SPP, PSI
PUMP RATE, GPM
25.0
20.0
15.0
10.0
5.0
0.0
5000
4500
4000
3500
3000
2500
2000
1500
1000
500
0
0
100
200
300
400
500
600
700
800
900
1000

METHODS TO PERFORM WELLBORE STRENGTHENING, METHODS TO PULSE HYDRAULIC FRACTURE A DOWNHOLE FORMATION, AND WELLBORE STRENGTHENING SYSTEMS

BACKGROUND

The present disclosure relates generally to methods to perform wellbore strengthening, methods to pulse hydraulic fracture a downhole formation, and wellbore strengthening systems.

Wellbore strengthening operations are sometimes performed to inject wellbore strengthening materials into fractures. A wellbore strengthening operation is sometimes performed to increase the hydraulic and hydrostatic pressure that the wellbore can sustain by changing the stress field in the near wellbore. More particularly, a surface-based pump, such as a rig pump, generates pressure to inject wellbore strengthening materials into existing near wellbore fractures and to create new near wellbore fractures.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Figure 2:
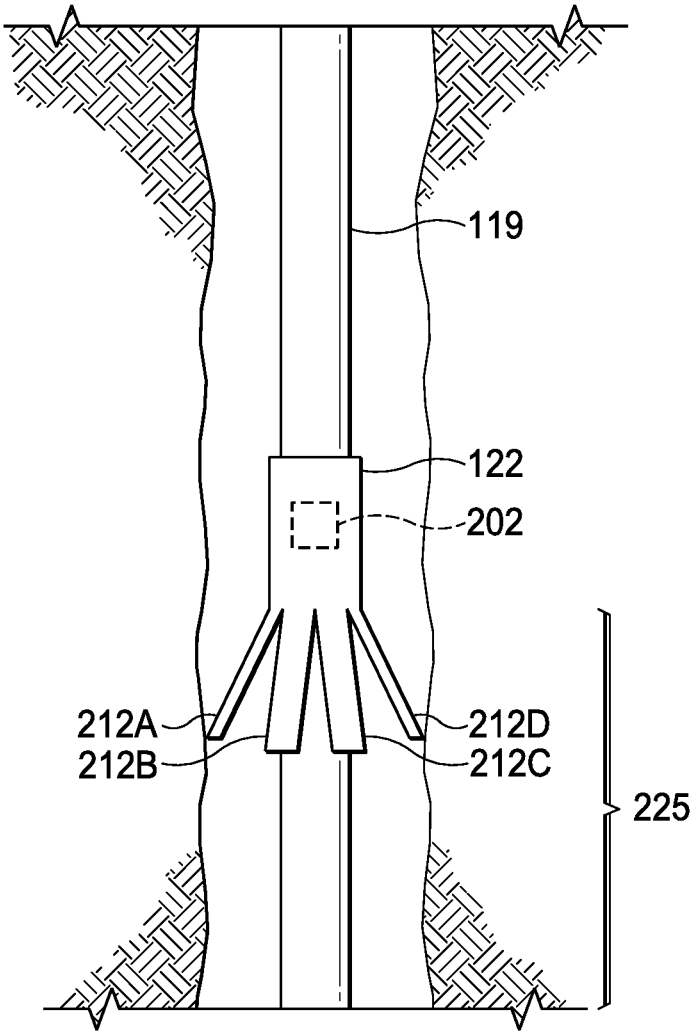
FIG. 2 is a schematic, side view of the annular isolation device of FIG. 1A.
Figure 3B:
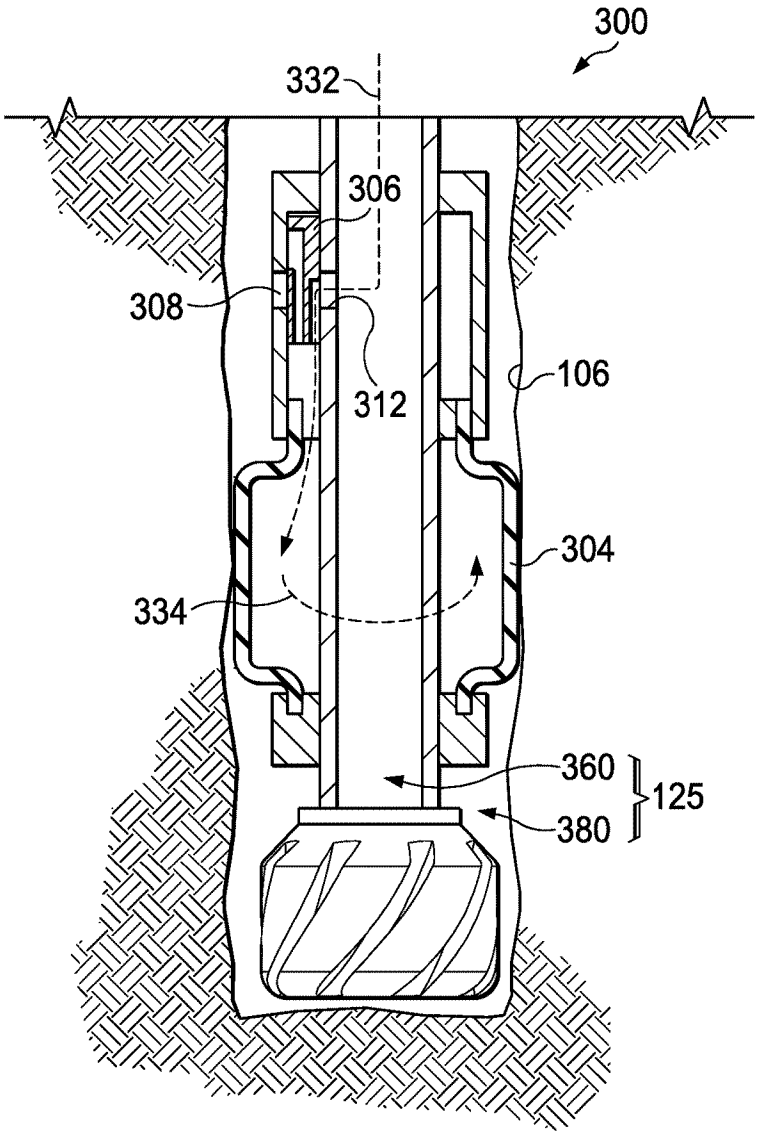
FIG. 3B is a schematic, cross-sectional view of the annular isolation device of FIG. 3A after the annular isolation device is activated.
Figure 3A:
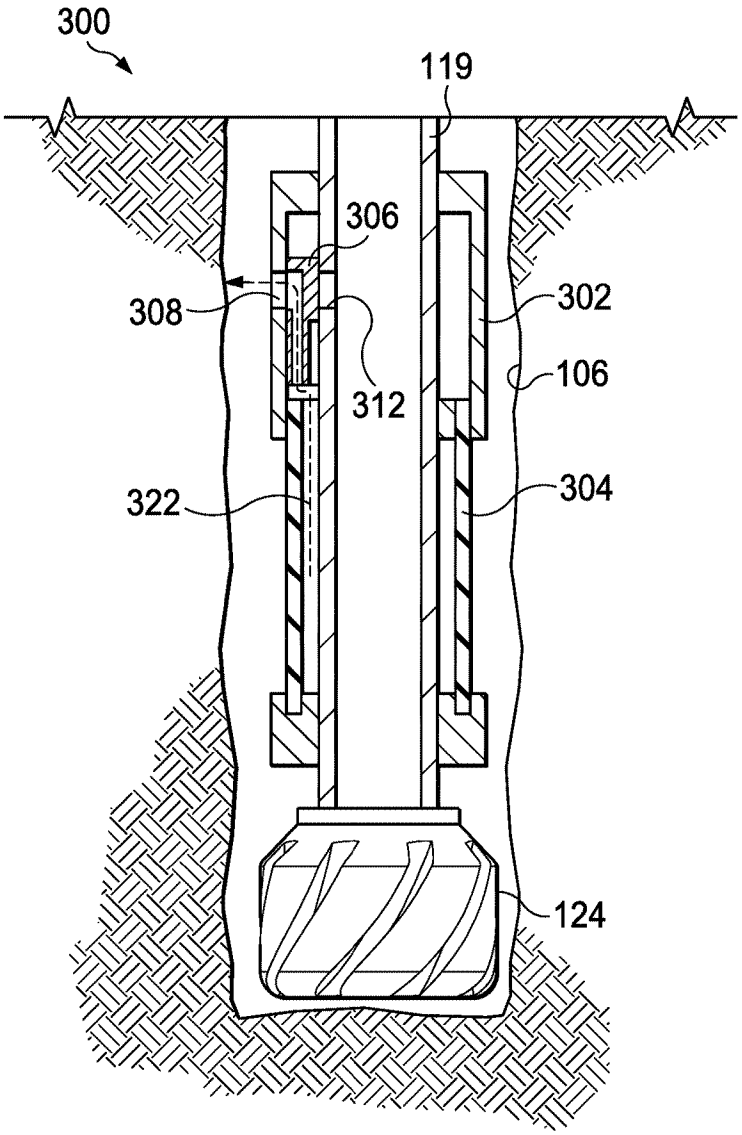
FIG. 3A is a schematic, cross-sectional view of another annular isolation device deployable in the environment of FIG. 1A.

The present disclosure relates to methods to perform wellbore strengthening, methods to pulse hydraulic fracture a downhole formation, and wellbore strengthening systems. A conveyance carrying a drilling tool (e.g., a drill bit) is deployed in a wellbore to perform a drilling operation. As referred to herein, a conveyance may be a production tubing, drill string, drill pipe, coiled tubing, or another type of tubular that is deployable downhole and having an inner diameter that provides fluid passage for fluids to flow downhole. In some embodiments, where the wellbore strengthening system is utilized in a hydraulic fracturing operation, the conveyance also carries a perforation tool used to perforate the wellbore. While the conveyance is deployed in the wellbore, the outer diameter of the conveyance and the inner diameter of the wellbore form an annular region. An annular isolation device is deployed in the annular region. As referred to herein, an annular isolation device is any device that is deployable in an annular region of a wellbore and configured to activate periodically (e.g., once per minute, once every five seconds, once every second, etc.) to fluidly seal the annular region. As referred to herein, an annular region or a zone of an annular region is fluidly sealed if fluid to flow through the annular region or the zone of the annular region is reduced to a threshold flow rate (e.g., 1 cubic meter per second, 1 cubic centimeter per second, 0 cubic meter per second, or another flow rate). Examples of annular isolation devices include, but are not limited to, annular packers, annular seals, and other annular isolation devices that are configured to activate periodically to fluidly seal an annular region. Additional descriptions of different types of annular isolation devices are provided in the paragraphs below and are illustrated in FIGS. 2, 3A, and 3B.

Figure 4:
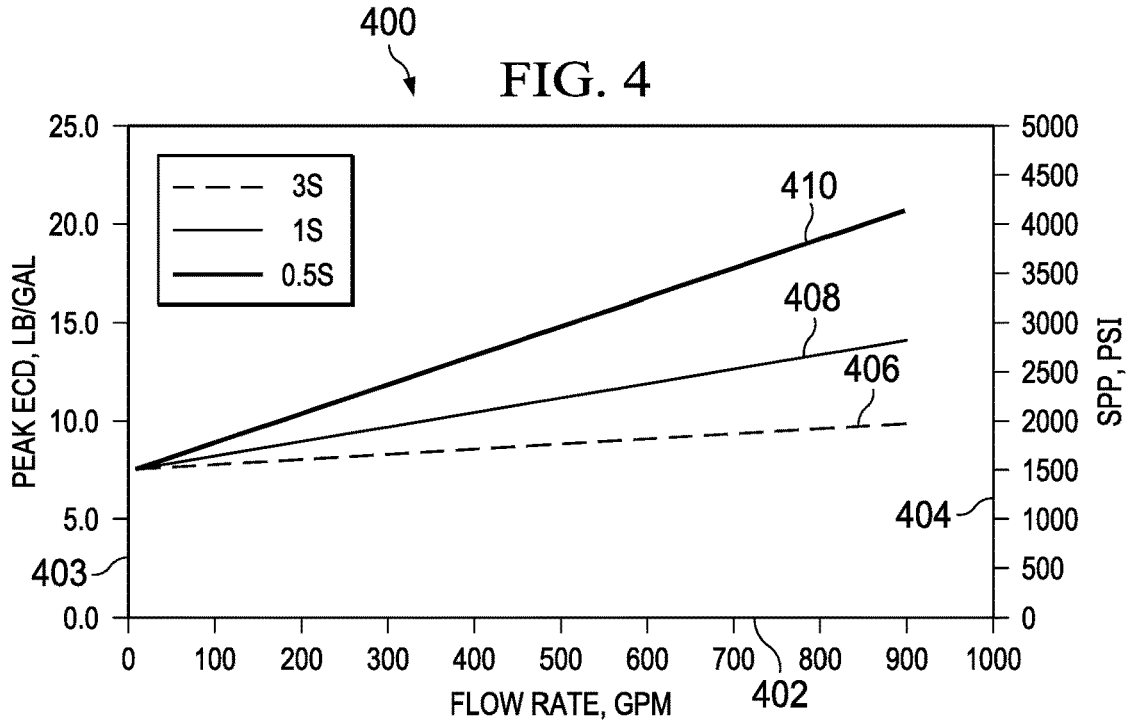
FIG. 4 is a line graph of varying intensities of hydraulic pressure of a 20 centipoise working fluid generated by activation of the annular isolation device of FIG. 2 at different activation speeds.
Figure 5:
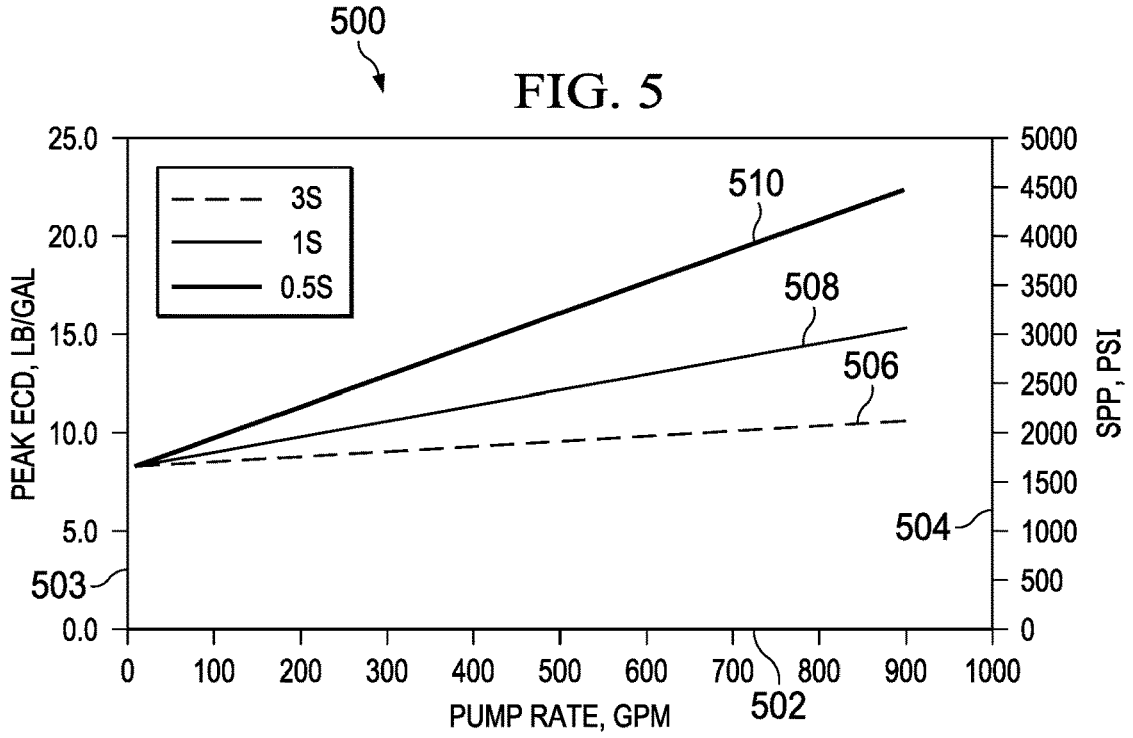
FIG. 5 is a line graph of varying intensities of hydraulic pressure of an un-viscosified fluid generated by the activation of the annular isolation device of FIG. 2 at different activation speeds.

Fluid carrying a loss circulation material is pumped downhole through an inner diameter of the conveyance where the fluid flows out of the conveyance and into the annular region. Examples of loss circulation material include, but are not limited to, ground and sized nut shells (such as walnut shells), ground marble, calcium carbonate, resilient graphitic carbon, fibrous materials, graphite, and barite. While fluid carrying the loss circulation material is pumped into the wellbore, the annular isolation device is activated to fluidly seal the annular region. Activation of the annular isolation device while fluids are being pumped into the annular region generates a hydraulic pulse that is similar to a water hammer phenomenon in the wellbore. The hydraulic pulse injects the fluids containing the loss circulation material into wellbore fractures induced by the increased wellbore pressure of the hydraulic pulse and into existing wellbore fractures. In some embodiments, the intensity of the hydraulic pulse is based on an activation speed of the annular isolation device. As referred to herein, an activation speed is the speed at which the annular isolation device is activated to fluidly seal the annular region. Moreover, increasing the activation speed refers to decreasing the amount of time it takes to activate the annular isolation device to form a seal, whereas decreasing the activation speed refers to increasing the amount of time it takes to activate the annular region. In one or more of such embodiments, the intensity of the hydraulic pulse is directly proportional to the activation speed of the annular isolation device. In that regard, FIGS. 4 and 5 illustrate line graphs of varying intensities of hydraulic pressure generated by an annular isolation device operating at different activation speeds to fluidly seal the annular region. In some embodiments, processors of the wellbore strengthening system determine a desired amount or concentration of loss circulation material to be injected into the fractures. The processors then determine an activation speed that would generate the desired amount of pressure, and designate the annular isolation device to fluidly seal the annular region around or above the activation speed.

In some embodiments, the annular isolation device is periodically activated (e.g., two times per minute, once every ten seconds, once every twenty seconds, or within another period) to generate multiple hydraulic pulses until a desired amount or concentration of loss circulation material is injected into the wellbore fractures. In one or more of such embodiments, the processors also determine a desired amount or concentration of loss circulation material to be injected into the fractures. The processors then determine a number of times to activate the annular isolation device (e.g., 2 times, 5 times, 10 times, or another number of times) to inject the desired amount or concentration of loss circulation material into the fractures, and designate the annular isolation device to periodically activate the determined number of times during a drilling operation to strengthen different sections of the wellbore as the wellbore is being drilled. In some embodiments, the processors determine the activation speed based on the fluid density of the fluids flowing into the annulus. In some embodiments, the processors determine the activation speed based on the pump rate of the pump that pumps the fluids into the annulus. In some embodiments, the processors determine a desired increase in wellbore pressure and determine the activation speed that would achieve the desired increase in wellbore pressure. In some embodiments, the annular isolation device is configured to periodically activate at varying activation speeds. For example, the annular isolation device is configured to fluidly seal the annular region in five seconds (first actuation speed), fluidly unseal the annular region, fluidly seal the annular region in three seconds (at a second activation speed), fluidly unseal the annular region, and fluidly seal the first region in two seconds (third activation speed) to progressively increase the intensity of the generated hydraulic pulses.

Figure 1A:
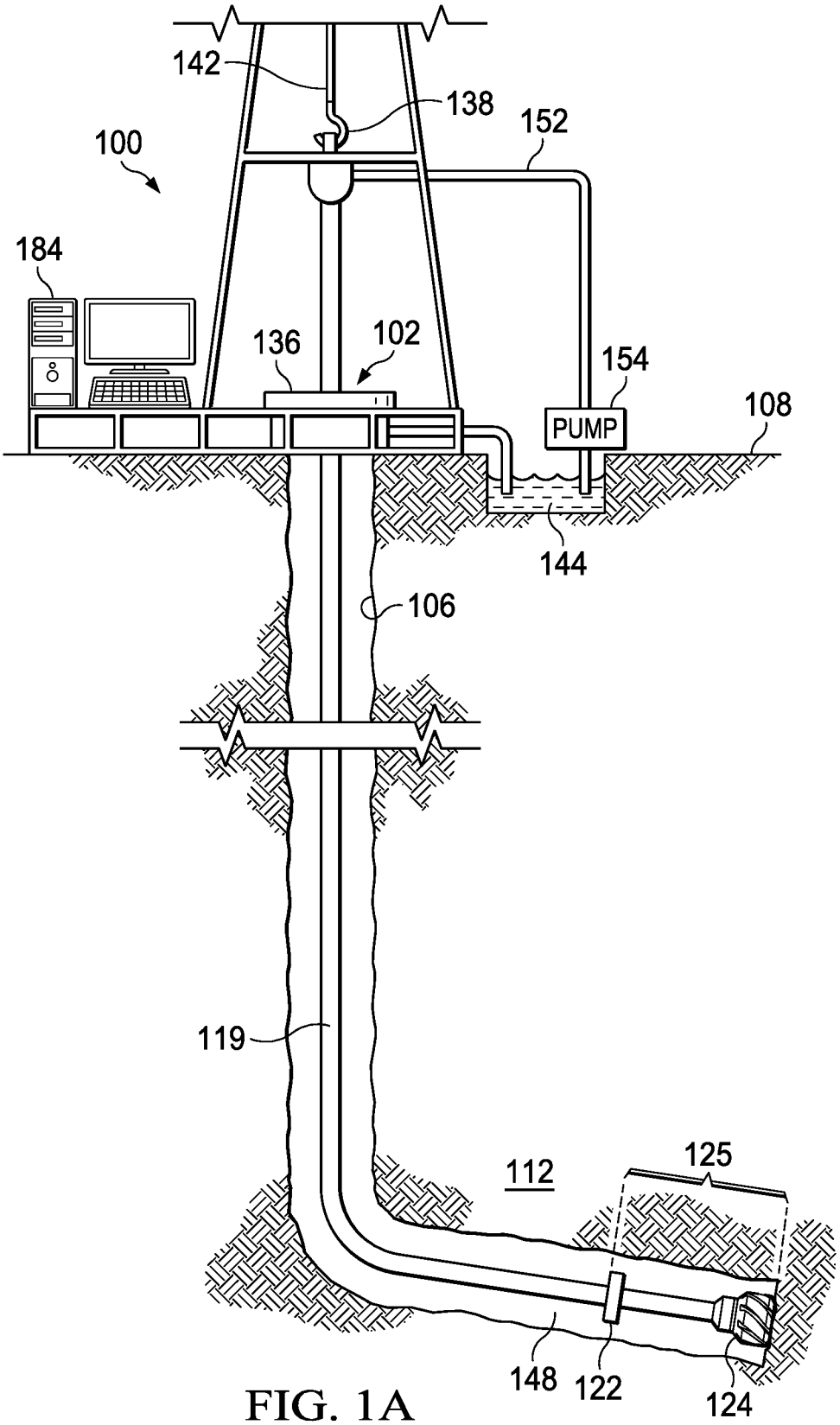
FIG. 1A is a schematic, side view of a drilling environment in which a wellbore strengthening system is deployed.
Figure 1B:
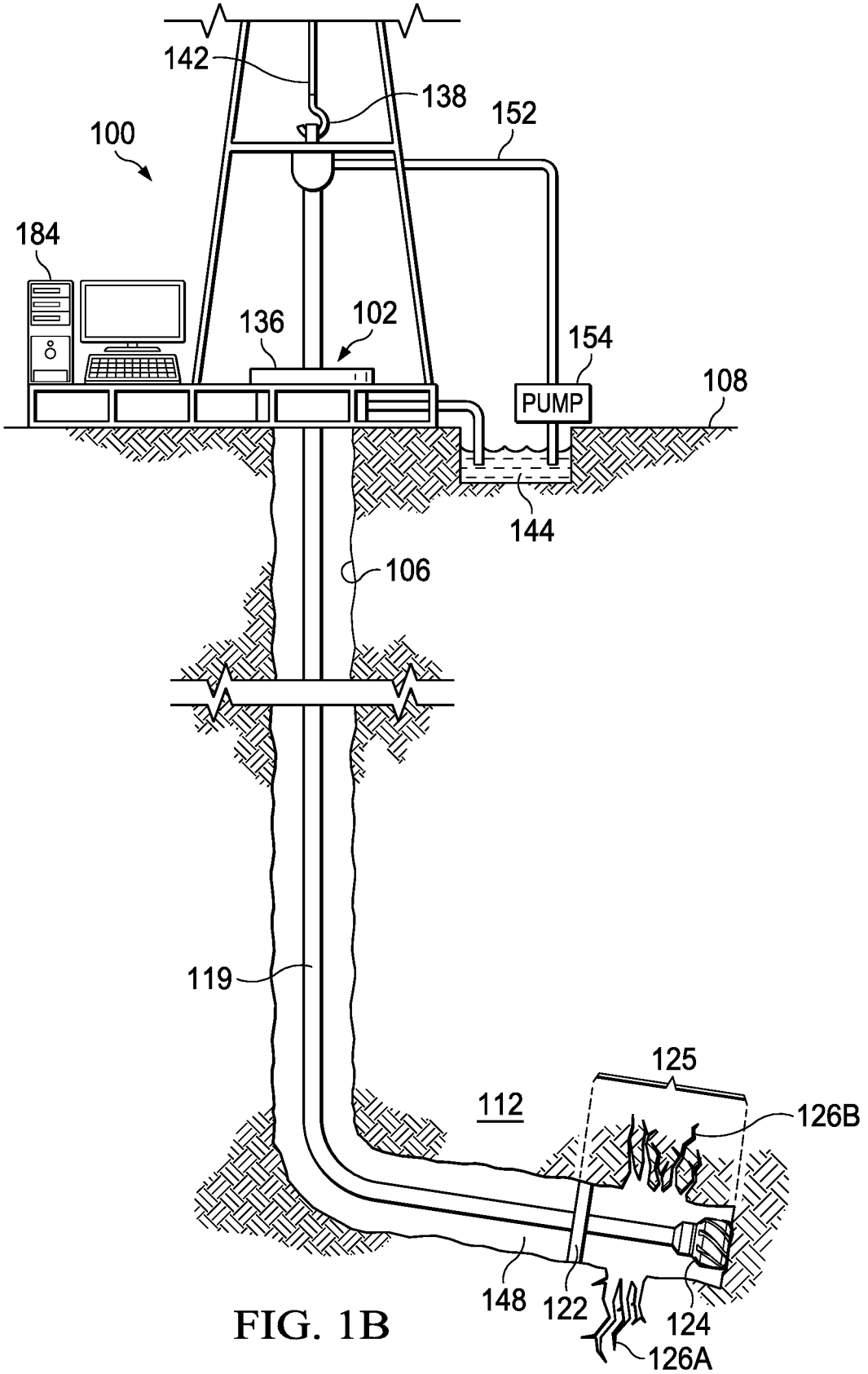
FIG. 1B is the schematic, side view of a drilling environment of FIG. 1A after an annular isolation device of FIG. 1A is activated.

In some embodiments, the annular isolation device is configured to periodically vary the activation speed of the annular isolation device based on the depth of the annular isolation device. For example, the annular isolation device is configured operate at the first activation speed if the annular isolation device is between 1,000 feet and 2,000 feet below surface, operate at the second activation speed if the annular isolation device is between 2,000 feet and 3,000 feet below surface, and operate at the third activation speed if the annular isolation device is between 3,000 feet and 4,000 feet below surface. In some embodiments, the annular isolation device is configured to (or a controller of FIGS. 1A and 1B is configured to request the annular isolation device) gradually increase the activation speed of the annular isolation device. In some embodiments, the annular isolation device is configured to (or the controller is configured to the request annular isolation device) determine a desired intensity of the hydraulic pulses, determine an activation speed that would generate the desired intensity, and gradually increase the activation speed of the annular isolation device until the activation speed is the determined activation speed. In some embodiments, the annular isolation device is configured to (or the controller is configured to request the annular isolation device) determine a desired intensity of the hydraulic pulses, determine an activation speed that would generate the desired intensity, and activate at the activation speed. In some embodiments, the annular isolation device is configured to (or the controller is configured to request the annular isolation device) determine a wellbore property of the wellbore. Examples of wellbore properties include, but are not limited to, fracture rating of the wellbore wall, permeability of the wellbore, density of fluids flowing into the wellbore, as well as other properties of the wellbore, surrounding formation, and fluids and particles flowing in the wellbore. In such embodiments, the annular isolation device is configured to (or the controller is configured to request the annular isolation device) determine an activation speed based on the wellbore property of the wellbore. Additional descriptions of operations performed to perform wellbore strengthening while drilling are provided in the paragraphs below.

Some of the foregoing operations are also performed to pulse hydraulic fracture a downhole formation. As described above, activating the annular isolation device to fluidly seal an annular region while fluid is pumped into the annular region generates a hydraulic pulse that injects fluid into fractures of the wellbore. In that regard, the annular isolation device is configured to activate and periodically seal the annular region to generate hydraulic pulses to fracture the downhole formation. Further, and as described herein, an increase of the activation speed of the annular isolation device also increases the intensity of the generated hydraulic pulse. In that regard, the annular isolation device is configured to vary or periodically vary the activation speed to generate hydraulic pulses having a desired intensity to fracture the downhole formation. Additional descriptions of methods to perform wellbore strengthening, methods to pulse hydraulic fracture a downhole formation, and wellbore strengthening systems are provided in the paragraphs below and are illustrated in at least FIGS. 1-7.

Turning now to the figures, FIG. 1A is a schematic, side view of a drilling environment 100, in which a wellbore strengthening system having an annular isolation device 122 and a pump 154 is deployed. In the embodiment of FIG. 1A, a well 102 having a wellbore 106 extends from a surface 108 of well 102 to or through a formation 112.

A hook 138, cable 142, traveling block (not shown), and hoist (not shown) are provided to lower a conveyance 119 down wellbore 106 of well 102 or to lift conveyance 119 up from wellbore 106 of well 102. In one or more embodiments, conveyance 119 may be a drill string, drill pipe, wireline, slickline, coiled tubing, production tubing, or another type of conveyance operable to be deployed in wellbore 106 and having an inner diameter that forms a fluid flow path for fluids to flow downhole and into wellbore 106. At a wellhead 136, an inlet conduit 152 is coupled to a fluid storage medium 144 to provide fluids, such as drilling fluids, carrier fluids, spacer fluids, as well as other types of fluids downhole. In some embodiments, the fluids carry a loss circulation material downhole. In the embodiment of FIG. 1A, conveyance 119 has an internal cavity that provides a fluid flow path from surface 108 to a downhole location.

In the embodiment of FIG. 1A, fluids are pumped by pump 154 downhole through conveyance 119. The fluids then exit conveyance 119 at a drill bit 124, and flow into an annular region 148 that is formed between the outer diameter of conveyance 119 and a wall of wellbore 106. As fluids flow into zone 125, hydraulic pressure exerted by the fluids onto a section of formation 112 in zone 125 forms induced fractures 126A and 126B (as shown in FIG. 1B), thereby creating fractures in formation 112 and extending existing fractures in formation 112. In some embodiments, conveyance 119 also provides telemetry of data indicative of one or more downhole properties and instructions to operate annular isolation device 122. Examples of downhole properties include, but are not limited to, the flow rate of fluids flowing into annular region 148, the concentration of materials, such as loss circulation materials carried by the fluids, the concentration of materials, such as loss circulation materials imbedded into fractures of formation 112, properties of fractures in formation 112, as well as other properties of well 102, and materials and devices used to perform operations described herein. Further, examples of instructions to operate annular isolation device 122 include, but are not limited to, instructions to activate or periodically activate annular isolation device 122 to fluidly seal annular region 148, the activation speed, variations in the activation speed, the number of times to activate annular isolation device 122, as well as other operational instructions described herein.

In some embodiments, sensors or transducers (not shown) are located at the lower end of conveyance 119 or on annular isolation device 122 as shown in FIG. 2. In one or more embodiments, sensors are built into a cylindrical drill collar that is positioned close to drill bit 124. While drilling is in progress, these sensors continuously or intermittently determine one or more downhole properties, and transmit the information to a surface detector by one or more telemetry techniques including, but not limited to, mud pulse telemetry, acoustic telemetry, and electromagnetic wave telemetry. In one or more embodiments, where a mud pulse telemetry system is deployed in wellbore 106 to provide telemetry, telemetry information is transmitted by adjusting the timing or frequency of viable pressure pulses in the drilling fluid that is circulated through conveyance 119 during drilling operations. In one or more embodiments, an acoustic telemetry system that transmits data via vibrations in the tubing wall of conveyance 119 is deployed in wellbore 106 to provide telemetry. More particularly, the vibrations are generated by an acoustic transmitter (not shown) mounted on conveyance 119 and propagate along conveyance 119 to an acoustic receiver (not shown) also mounted on conveyance 119. In one or more embodiments, an electromagnetic wave telemetry system that transmits data using current flows induced in conveyance 119 is deployed in wellbore 106 to provide telemetry. Additional types of telemetry systems may also be deployed in wellbore 106 to transmit data from tools (not shown) and other downhole components to a surface-based electronic device, such as controller 184.

Turning to FIG. 1B, FIG. 1B illustrates is the schematic, side view of the drilling environment of FIG. 1A after annular isolation device 122 of FIG. 1A is activated while fluids are pumped through conveyance 119 downhole. Activation of annular isolation device 122 forms a seal between conveyance 119 and the wall of wellbore 106, thereby fluidly isolating zone 125 from other zones of annular region 148 further uphole from zone 125, and reducing fluid flow in zone 125. As referred to herein, fluid flow is reduced if the flow rate of the fluid is reduced to or below a threshold (e.g., 1 gallon per second, 0.1 gallons per second, 0, or another flow rate). The sudden reduction of fluid flow in zone 125 generates a hydraulic pulse towards fractures 126A and 126B, injecting the fluids and loss circulation material into induced fractures. Further, in some embodiments, where existing fractures (not shown) extend through zone 125, the generated hydraulic pulse enlarges or enhances the existing fractures. In the embodiment of FIG. 1B, the generated water pressure injects fluids carrying the lost circulation materials into factures 126A and 126B. The lost circulation materials remain embedded in fractures 126A and 126B, which changes the stress state of formation 112 near wellbore 106, thereby strengthening wellbore 106. In some embodiments, an annular choke device located at the surface 108 is used in concert with actuation of annular isolation device 122 or is used in lieu of annular isolation device 122.

As stated herein, the intensity of a hydraulic pulse generated by fluidly sealing an annular region is based on the activation speed of an annular isolation device, such as annular isolation device 122. Further, in some embodiments, repeatedly activating an annular isolation device, such as annular isolation device 122, creates new fractures, extends existing fractures, and injects additional amounts of materials into fractures.

In some embodiments, a surface-based electronic device, such as controller 184, includes one or more processors operable to receive data indicative of downhole properties and determine operational parameters on how to operate annular isolation device 122 based on the downhole properties. In one or more of such embodiments, processors of controller 184 determine a desired mass concentration of the loss circulation material to be injected into the pumping system to be pumped downhole (e.g., a spacer), determine an activation speed of annular isolation device 122 that would inject the desired mass concentration of the loss circulation material, and transmit a request to annular isolation device 122 to operate at the activation speed to fluidly seal annular region 148 at the time the loss circulation material is in zone 125. In one or more of such embodiments, processors of controller 184 determine a desired intensity of the hydraulic pulse, and determine an activation speed of annular isolation device 122 that would generate the desired intensity, and request annular isolation device 122 to operate at the activation speed to fluidly seal the annular region. In one or more of such embodiments, where the fluids contain a mixture of a wellbore strengthening spacer fluid having a first density with a carrier fluid having a second density that is lower than the first density, the one or more processors of annular isolation device 122 determine ratios and interfaces of the wellbore strengthening spacer fluid and carrier fluids to be mixed, and form the mixture in accordance with the determined specifications before the mixture is pumped downhole. In one or more of such embodiments, processors of controller 184 access algorithms that determine a threshold number of pump strokes to place the wellbore strengthening spacer fluid in position in zone 125 of annular region 148 and at or near fractures 126A and 126B, and the timing for the actuation of annular isolation device 122 to achieve the desired pressure to fill fractures 126A and 126B with the wellbore strengthening spacer fluid.

In some embodiments, pressure in zone 125 is maintained for a threshold period of time (e.g., 10 seconds, 1 minute, or another period of time) to allow fluid carrying the loss circulation material to leak off into formation 112, leaving the loss circulation material inside fractures 126A and 126B. Additional operations of processors of controller 184 are described herein and are illustrated in at least FIGS. 5 and 6.

Although FIGS. 1A and 1B illustrate controller 184 as a surface-based electronic device, in some embodiments, controller 184 is located downhole or is located in another surface-based location remote from well 102. In some embodiments, controller 184 is a component of annular isolation device 122. In some embodiments, the wellbore strengthening system of FIGS. 1A and 1B also includes controller 184. In some embodiments, the well strengthening system of FIGS. 1A and 1B also includes drill bit 124, conveyance 119, and a pressure valve. Although FIGS. 1A and 1B illustrate a drilling environment, annular isolation device 122 and the wellbore strengthening system of FIGS. 1A and 1B are also deployable in hydraulic fracturing, logging-while-drilling, measurement-while-drilling, pre-drilling, and other well operations to generate hydraulic pulses.

FIG. 2 is a schematic, side view of annular isolation device 122 of FIG. 1A. As shown in FIG. 2, annular isolation device 122 is coupled to conveyance 119 and includes a sensor 202 that is configured to measure downhole properties such as, but not limited to, the flow rate of fluids flowing into annular region 148 of FIGS. 1A and 1B, the concentration of materials such as loss circulation materials carried by the fluids, the concentration of materials, such as loss circulation materials imbedded into fractures of the formation, properties of fractures in the formation, as well as other properties of the well, and materials and devices used to perform operations described herein. Annular isolation device 122 also includes blades 212A-212D that are configured to extend radially outward to engage the wellbore to fluidly seal a zone 225 of an annular region, and extend axially to disengage the wellbore, thereby allowing fluid to flow through zone 225 of the annular region. In some embodiments, blades 212A-212D periodically extend radially outward to fluidly seal zone 225. In some embodiments, blades 212A-212D are configurable to operate at different activation speeds within a range of activation speeds (e.g., between 0.5 seconds and 10 seconds or within another range) to fluidly seal zone 225. In some embodiments, blades 212A-212D are configurable to periodically extend radially outward to fluidly seal zone 225, and periodically extend axially to allow fluid to flow through zone 225 multiple times within a period of time (e.g., fluidly seal zone 225 three times, five times, eight times or a different number of times within one minute or within another period of time).

In some embodiments, annular isolation device 122 also includes a transmitter and a receiver configured to transmit signals indicative of downhole properties and to receive operational instructions from a surface-based device such as controller 184 or another downhole device. In some embodiments, annular isolation device 122 includes a storage medium (not shown) that stores data indicative of downhole properties and operational instructions in the storage medium. In some embodiments, annular isolation device 122 also includes processors operable to perform operations described herein to determine operational parameters of blades 212A-212D. Examples of operational parameters include, but are not limited to, forming a fluid seal within a threshold time (e.g., within three seconds) to generate a desired amount of hydraulic pressure, forming a fluid seal a threshold number of times (e.g., ten times) within a period of time (e.g., one minute) to inject a desired amount or concentration of loss circulation material into nearby fractures, varying the activation speed of blades 212A-212D (e.g., form a first fluid seal in five seconds, form a second fluid seal in four seconds, and form a third fluid seal in three seconds) as well as other operational parameters described herein. The processors then configure blades 212A-212D to activate in accordance to the determined operational parameters. Although FIG. 2 illustrates an annular isolation device 122 having four blades 212A-212D, in some embodiments, annular isolation device 122 has a different number of blades. Further, although blades 212A-212D of FIG. 2 are configured to extend radially or axially, in some embodiments, blades of the annular isolation device have other configurations.

FIG. 3A is a schematic, cross-sectional view of another annular isolation device 300 that is deployable in the environment of FIG. 1A. More particularly, FIG. 3A illustrates the physical state of annular isolation device 300 while annular isolation device 300 is not being activated. As shown in FIG. 3A, annular isolation device 300 is coupled to conveyance 119 and near drill bit 124. Annular isolation device 300 includes a housing 302 having a vented port 308, an elastomeric seal 304, and a shuttle valve 306 configured to switch from a first position illustrated in FIG. 3A to a second position illustrated in FIG. 3B to actuate annular isolation device 300. In the embodiment of FIG. 3A, elastomeric seal 304 is deflated by fluids flowing in an annular region between conveyance 119 and wellbore 106. Further, shuttle valve 306 is in a first position that covers port 312 to prevent fluid flow from conveyance 119 into annular isolation device 300. Fluids stored in annular isolation device 300 before shuttle valve 306 is switched to the first position flow along a fluid flow path illustrated by arrow 322 out of vented port 308 of annular isolation device 300, and into the annular region. In the embodiment of FIG. 3A, fluids flowing in conveyance 119 do not pressurize annular isolation device 300.

FIG. 3B is a schematic, cross-sectional view of the annular isolation device of FIG. 3A after the annular isolation device is activated. More particularly, shuttle valve 306 has switched from the first position illustrated in FIG. 3A to the second position to uncover port 312 and to cover vented port 308. Fluids pumped down conveyance 119 flow from port 312 into annular isolation device 300 along flow paths illustrated by arrows 332 and 334 to fill an area of annular isolation device 300, and thereby increasing the pressure inside annular isolation device 300 (e.g., at location 360) relative to the pressure outside annular isolation device 300 (e.g., at location 380). The pressure differential between pressure inside and outside annular isolation device 300 pressurizes elastomeric seal 304 to expand to the walls of wellbore 106, thereby fluidly sealing zone 125, and generating a hydraulic pulse.

In some embodiments, annular isolation device 300 of FIGS. 3A and 3B also includes a sensor (not shown) similar to sensor 202 of FIG. 2. In some embodiments, annular isolation device 300 also includes a transmitter and a receiver configured to transmit signals indicative of downhole properties and receive operational instructions from a surface-based device such as controller 184 of FIGS. 1A and 1B or from another downhole device. In some embodiments, annular isolation device 300 includes a storage medium (not shown) that stores data indicative of downhole properties and operational instructions in the storage medium. In some embodiments, annular isolation device 300 also includes processors operable to perform operations described herein to determine operational parameters of elastomeric seal 304 and shuttle valve 306. Examples of operational parameters include, but are not limited to, forming a fluid seal within a threshold time (e.g., within three seconds) to generate a desired amount of hydraulic pressure, forming a fluid seal a threshold number of times (e.g., ten times) within a period of time (e.g., one minute) to inject a desired amount or concentration of loss circulation material into nearby fractures, varying the activation speed of elastomeric seal 304 (e.g., form a first fluid seal in five seconds, form a second fluid seal in four seconds, and form a third fluid seal in three seconds) as well as other operational parameters described herein.

FIG. 4. is a line graph 400 of varying intensities of hydraulic pressure of a 20 centipoise working fluid generated by activation of the annular isolation device of FIG. 2 at different activation speeds. In the illustrated embodiment of FIG. 4, axis 402 represents a pump rate of a pump (such as pump 154 of FIG. 1A) that pumps fluids downhole and measured in gallons per minute (gpm). Further, axis 403 represents the equivalent circulating density of the 20 centipoise working fluid measured in pounds per gallon (lb/gal). Further, axis 404 represents pressure measured in pounds per square inch (psi). Further, line 406 illustrates pressure of the 20 centipoise working fluid generated by activation of annular isolation device 122 at an activation speed of two seconds (annular isolation device 122 fluidly seals zone 225 of FIG. 2 in two seconds), line 408 illustrates pressure of the 20 centipoise working fluid generated by activation of annular isolation device 122 at an activation speed of one second (annular isolation device 122 fluidly seals zone 225 in one second), and line 410 illustrates pressure of the 20 centipoise working fluid generated by activation of annular isolation device 122 at an activation speed of half a second (annular isolation device 122 fluidly seals zone 225 of FIG. 2 in half a second).

As shown in FIG. 4, increasing the activation speed of annular isolation device 122 from two seconds to one second while the 20 centipoise working fluid is pumped at a rate of approximately 900 gallons per minute increases the intensity of the fluid pressure generated by activation of annular isolation device 122 from approximately 2,000 psi to approximately 3,000 psi, an approximate increase of 1,000 psi. Further, increasing the activation speed of annular isolation device 122 from one second to half a second while the 20 centipoise working fluid is pumped at a rate of approximately 900 gallons per minute increases the intensity of the fluid pressure generated by activation of annular isolation device 122 from approximately 3,000 psi to approximately 4,500 psi, an approximate increase of 1,500 psi.

FIG. 5 is a line graph 500 of varying intensities of hydraulic pressure of an un-viscosified fluid generated by activation of annular isolation device 122 of FIG. 2 at different activation speeds. In the illustrated embodiment of FIG. 5, axis 502 represents a pump rate of a pump such as pump 154 of FIG. 1A that pumps fluids downhole and measured in gpm. Further, axis 503 represents the equivalent circulating density of the un-viscosified fluid measured in lb/gal. Further, axis 504 represents pressure measured in psi. Further, line 506 illustrates pressure of the un-viscosified fluid generated by activation of annular isolation device 122 at an activation speed of two seconds (annular isolation device 122 fluidly seals zone 225 of FIG. 2 in two seconds), line 508 illustrates pressure of the un-viscosified fluid generated by activation of annular isolation device 122 at an activation speed of one second (annular isolation device 122 fluidly seals zone 225 in one second), and line 510 illustrates pressure of the un-viscosified fluid generated by activation of annular isolation device 122 at an activation speed of half a second (annular isolation device 122 fluidly seals zone 225 of FIG. 2 in half a second).

As shown in FIG. 5, increasing the activation speed of annular isolation device 122 of FIG. 2 from two seconds to one second while the un-viscosified fluid is pumped at a rate of approximately 900 gallons per minute increases the intensity of the fluid pressure generated by activation of annular isolation device 122 from approximately 2,000 psi to approximately 3,000 psi, an approximate increase of 1,000 psi. Further, increasing the activation speed of annular isolation device 122 from one second to half a second while the un-viscosified fluid is pumped at a rate of approximately 900 gallons per minute increases the intensity of the fluid pressure generated by activation of annular isolation device 122 from approximately 3,000 psi to approximately 4,500 psi, an approximate increase of 1,500 psi. In that regard, further increasing the activation speed of annular isolation device 122 would further increase the fluid pressure generated by activation of annular isolation device 122. Moreover, a desired pressure intensity (e.g., 2,500 psi, 3,300 psi, or a different intensity) is generated by determining an activation speed that would generate the desired pressure intensity and activating an annular isolation device such as annular isolation device 122 of FIG. 2 at the determine activation speed.

Figure 6:
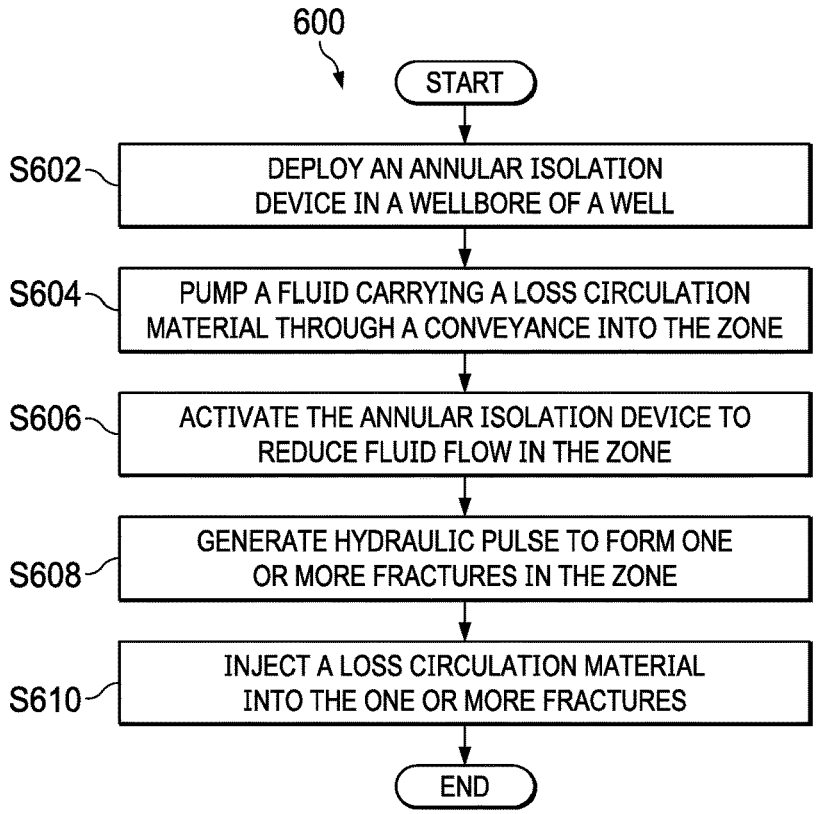
FIG. 6 illustrates a flowchart of a process to perform wellbore strengthening while drilling.

FIG. 6 illustrates a flowchart 600 of a process to perform wellbore strengthening while drilling. Although the operations in the process 600 are shown in a particular sequence, certain operations may be performed in different sequences or at the same time where feasible. At block S602, an annular isolation device is deployed in a well. FIGS. 1A and 1B, for example, illustrate deploying annular isolation device 122 into well 102. At block S604, a fluid carrying a loss circulation material is pumped through a conveyance into a zone of an annular region of the wellbore. In the embodiment of FIGS. 1A and 1B, pump 154 pumps a fluid carrying a loss circulation material through conveyance 119 downhole, where the fluid and the loss circulation material flow out of drill bit 124 and into zone 125 of wellbore 106. At block S606, the annular isolation device is activated to reduce fluid flow in the zone. FIG. 1B illustrates activation of annular isolation device 122 to fluidly seal zone 125. At block S608, a hydraulic pulse is generated to form one or more fractures. In that regard, activation of annular isolation device 122 reduces fluid flow in zone 125, thereby generating a hydraulic pulse that forms fractures 126A and 126B of FIG. 1B. At block S610, a loss circulation material is injected into the one or more fractures. The generated hydraulic pulse injects fluids containing the loss circulation material into fractures 126A and 126B of FIG. 1B.

In some embodiments, the annular isolation device is configured to periodically activate (e.g., once every five seconds, once every ten seconds, once every minute, or once within a threshold duration), and to periodically generate hydraulic pulses to form the fractures and to inject the loss circulation material into the fractures. In some embodiments, the annular isolation device is configured to activate at different activation speeds (e.g., activate a first time in two seconds, activate a second time in one second, and activate a third time in half a second) to vary the intensity of the hydraulic pulses generated by activation of the annular isolation device. In one or more of such embodiments, the annular isolation device is configured to gradually increase the activation speed of the annular isolation device. In some embodiments, the foregoing operations are performed by processors of an electronic device, such as controller 184 of FIGS. 1A and 1B, processors of an onboard component, or processors of another downhole device or tool. In one or more of such embodiments, the processors provide additional operational instructions and operational parameters to the activation device to perform the determined operations in accordance with the operational instructions and parameters.

Figure 7:
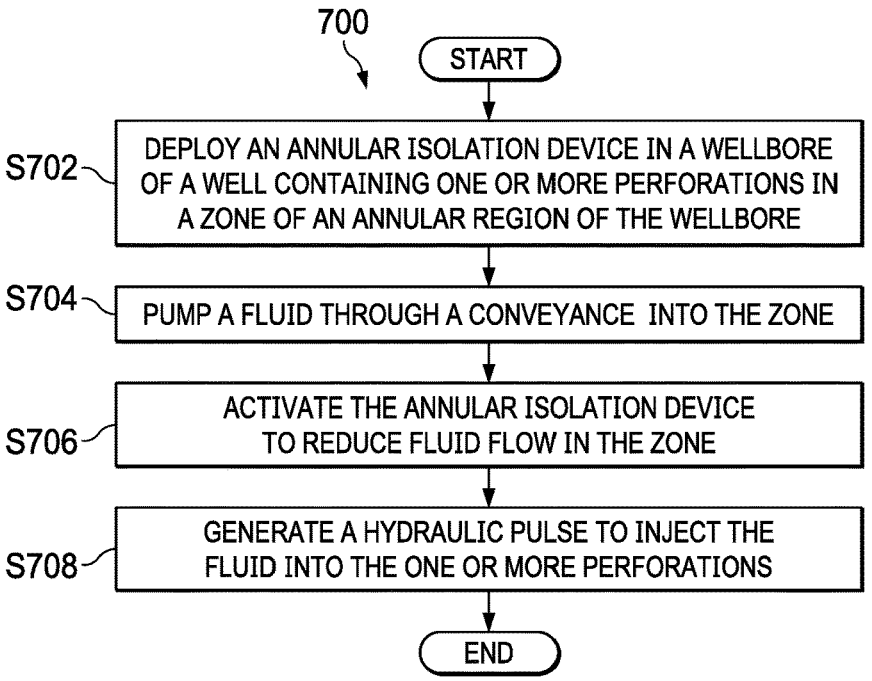
FIG. 7 illustrates a flowchart of a process to pulse hydraulic fracture a downhole formation.

FIG. 7 illustrates a flowchart of a process 700 to pulse hydraulic fracture a downhole formation. Although the operations in the process 700 are shown in a particular sequence, certain operations may be performed in different sequences or at the same time where feasible.

At block S702, an annular isolation device is deployed in a wellbore of a well containing one or more perforations in a zone of an annular region of the wellbore. For example, during a hydraulic fracturing operation, annular isolation device 122 is deployable in a zone of a wellbore similar to wellbore 106 of FIG. 1A, and near one or more perforations. At block S704, fluid is pumped through a conveyance into the zone. Continuing with the foregoing example, a pump pumps a fluid through a conveyance downhole, where the fluid flows out of the conveyance and into the zone of the wellbore. In some embodiments, a mixture of a carrier fluid having a first density and a spacer fluid having a second and higher density is pumped through the conveyance downhole.

At block S706, the annular isolation device is activated to reduce fluid flow in the zone. Continuing with the foregoing example, the annular isolation device is subsequently activated to fluidly seal the zone. At block S708, a hydraulic pulse is generated to inject the fluid into the one or more perforations. In that regard, activation of the annular isolation device reduces fluid flow in the zone, thereby generating a hydraulic pulse which injects fluids into the perforations to create fractures and to enhance existing fractures. In some embodiments, where a mixture of spacer fluid and carrier fluid is pumped downhole, the mixture is injected into the perforations to create new perforations and to enhance existing perforations.

In some embodiments, the annular isolation device is configured to periodically activate (e.g., once every five seconds, once every ten seconds, once every minute, or once within a threshold duration), and to periodically generate hydraulic pulses to inject fluids and any solid particles carried by the fluids into the perforations. In some embodiments, the annular isolation device is configured to activate at different activation speeds (e.g., activate a first time in two seconds, activate a second time in one second, and activate a third time in half a second) to vary the intensity of the hydraulic pulses generated by activation of the annular isolation device. In some embodiments, the foregoing operations are performed by processors of an electronic device, such as controller 184 of FIGS. 1A and 1B, processors of an onboard component, or processors of another downhole device or tool. In one or more of such embodiments, the processors provide additional operational instructions and operational parameters to the activation device to perform the determined operations in accordance with the operational instructions and parameters. In some embodiments, where a mixture of a carrier fluid having a first density and a spacer fluid having a second and higher density is used, the processors also determine a ratio of the carrier fluid and spacer fluid to be injected into the perforations.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a method to perform wellbore strengthening while drilling, the method comprising: deploying an annular isolation device in a wellbore of a well; pumping a fluid carrying a loss circulation material through a conveyance into a zone of an annular region of the wellbore; activating the annular isolation device to reduce fluid flow in the zone; generating a hydraulic pulse to form one or more fractures in the zone; and injecting a loss circulation material into the one or more fractures.

Clause 2, the method of clause 1, further comprising: periodically activating the annular isolation device to reduce fluid flow in the zone; and periodically generating a plurality of hydraulic pulses to inject the loss circulation material into the one or more fractures.

Clause 3, the method of clause 2, wherein periodically activating the annular isolation device comprises activating the annular isolation device a number of times within a period of time.

Clause 4, the method of clause 3, further comprising varying an activation speed of the annular isolation device at different times the annular isolation device is activated.

Clause 5, the method of any of clauses 2-4, wherein periodically activating the annular isolation device comprises gradually increasing an activation speed of the annular isolation device.

Clause 6, the method of clause 5, further comprising: determining a desired intensity of the hydraulic pulses; and determining an activation speed of the annular isolation device that would generate hydraulic pulses having the desired intensity, wherein the activation speed of the annular isolation device is gradually increased until the activation speed reaches the determined activation speed.

Clause 7, the method of any of clauses 1-6, further comprising: determining a desired intensity of the hydraulic pulse; and determining an activation speed of the annular isolation device based on the desired intensity of the hydraulic pulse, wherein activating the annular isolation device comprises activating the annular isolation device at the determined activation speed.

Clause 8, the method of any of clauses 1-7, further comprising: determining a wellbore property of the wellbore; and determining an activation speed of the annular isolation device based on the wellbore property of the wellbore, wherein activating the annular isolation device comprises activating the annular isolation device at the determined activation speed.

Clause 9, the method of any of clauses 1-8, wherein the loss circulation material comprises walnut, ground marble, calcium carbonate, resilient graphitic carbon, fibrous materials, graphite, and barite.

Clause 10, a method to pulse hydraulic fracture a downhole formation, the method comprising: deploying an annular isolation device in a wellbore of a well containing one or more perforations in a zone of an annular region of the wellbore; pumping a fluid through a conveyance into the zone; activating the annular isolation device to reduce fluid flow in the zone; and generating a hydraulic pulse to inject the fluid into the one or more perforations.

Clause 11, the method of clause 10, further comprising: periodically activating the annular isolation device to reduce fluid flow in the zone; and periodically generating hydraulic pulses to inject the fluid into the one or more perforations.

Clause 12, the method of clause 11, further comprising: determining a desired intensity of the hydraulic pulses; and determining an activation speed of the annular isolation device based on the desired intensity of the hydraulic pulse, wherein activating the annular isolation device comprises activating the annular isolation device at the activation speed.

Clause 13, a wellbore strengthening system, comprising: a pump configured to pump a fluid through a conveyance deployed in a well into a zone of an annular region of the wellbore; and an annular isolation device disposed in the zone and configured to fluidly seal the annular region to form one or more fractures in the zone.

Clause 14, the wellbore strengthening system of clause 13, wherein the pump is configured to pump a loss circulation material into the zone, and wherein the system further comprises one or more processors operable to: determine a desired mass concentration of the loss circulation material to be injected into the one or more fractures; determine an activation speed of the annular isolation device that generates a hydraulic pulse to inject the desired mass concentration of the loss circulation material; and request the annular isolation device to operate at the activation speed to fluidly seal the annular region.

Clause 15, the wellbore strengthening system of clause 14, wherein the one or more processors is further operable to request the annular isolation device to periodically form fluid seals of the annular region.

Clause 16, the wellbore strengthening system of clauses 14 or 15, wherein the one or more processors is further operable to: determine a desired intensity of the hydraulic pulse; determine an activation speed of the annular isolation device that generates the desired intensity; and request the annular isolation device to operate at the activation speed to fluidly seal the annular region.

Clause 17, the wellbore strengthening system of any of clauses 14-16, wherein the one or more processors is further operable to: determine a wellbore property of the wellbore; determine an activation speed of the annular isolation device based on the wellbore property of the wellbore; and request the annular isolation device to operate at the activation speed to fluidly seal the annular region.

Clause 18, the wellbore strengthening system of any of clauses 13-17, further comprising a pressure valve configured to maintain pressure in the wellbore within a threshold pressure range.

Clause 19, the wellbore strengthening system of any of clauses 13-18, wherein the annular isolation device is configured to engage a plurality of blades of the annular isolation device to extend radially outward to engage a wall of the wellbore and to fluidly seal the annular region.

Clause 20, the wellbore strengthening system of any of clauses 13-18, wherein the annular isolation device is configured to expand an elastomeric seal to engage a wall of the wellbore and to fluidly seal the annular region.

Unless otherwise specified, any use of any form of the terms "connect," "engage," "couple," "attach," or any other term describing an interaction between elements in the foregoing disclosure is not meant to limit the interaction to direct interaction between the elements and may also include indirect interaction between the elements described. As used herein, the singular forms "a", "an," and "the" are intended to include the plural forms as well, unless the context clearly indicates otherwise. Unless otherwise indicated, as used throughout this document, "or" does not require mutual exclusivity. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

It should be apparent from the foregoing that embodiments of an invention having significant advantages have been provided. While the embodiments are shown in only a few forms, the embodiments are not limited but are susceptible to various changes and modifications without departing from the spirit thereof

What is claimed:

1. A method to perform wellbore strengthening while drilling, the method comprising:

deploying an annular isolation device in a wellbore of a well;

pumping a fluid carrying a loss circulation material through a conveyance into a zone of an annular region of the wellbore;

activating the annular isolation device to reduce fluid flow in the zone;

determining a desired intensity of hydraulic pulses to inject the fluid into the wellbore;

determining an activation speed of the annular isolation device that would generate a plurality of hydraulic pulses having the desired intensity, wherein the activation speed of the annular isolation device is gradually increased until the activation speed reaches the determined activation speed;

periodically generating the plurality of hydraulic pulses to form one or more fractures in the zone; and injecting the loss circulation material into the one or more fractures.

2. The method of claim 1, further comprising:

periodically activating the annular isolation device to reduce fluid flow in.

3. The method of claim 2, wherein periodically activating the annular isolation device comprises activating the annular isolation device a number of times within a period of time.

4. The method of claim 3, further comprising varying the activation speed of the annular isolation device at different times the annular isolation device is activated.

5. The method of claim 2, wherein periodically activating the annular isolation device comprises gradually increasing the activation speed of the annular isolation device.

6. The method of claim 1, wherein activating the annular isolation device comprises activating the annular isolation device at the determined activation speed.

7. The method of claim 1, further comprising:

determining the activation speed of the annular isolation device based on the wellbore property of the wellbore, wherein activating the annular isolation device comprises activating the annular isolation device at the determined activation speed.

8. The method of claim 1, wherein the loss circulation material comprises walnut, ground marble, calcium carbonate, resilient graphitic carbon, fibrous materials, graphite, and barite.

9. A method to pulse hydraulic fracture a downhole formation, the method comprising:

deploying an annular isolation device in a wellbore of a well containing one or more perforations in a zone of an annular region of the wellbore;

pumping a fluid through a conveyance into the zone;

activating the annular isolation device to reduce fluid flow in the zone; and determining a desired intensity of hydraulic pulses to inject the fluid into the wellbore;

determining an activation speed of the annular isolation device that would generate a plurality of hydraulic pulses having the desired intensity, wherein the activation speed of the annular isolation device is gradually increased until the activation speed reaches the determined activation speed; and periodically generating a plurality of hydraulic pulses generating to inject the fluid into the one or more perforations.

10. The method of claim 9, further comprising:

periodically activating the annular isolation device to reduce fluid flow in the zone.

11. A wellbore strengthening system, comprising:

a pump configured to pump a fluid through a conveyance deployed in a wellbore of a well into a zone of an annular region of the wellbore;

an annular isolation device disposed in the zone and configured to fluidly seal the annular region to form one or more fractures in the zone; and one or more processors operable to:

determine a desired mass concentration of the loss circulation material to be injected into the one or more fractures;

determine an activation speed of the annular isolation device that generates a hydraulic pulse to inject the desired mass concentration of the loss circulation material; and request the annular isolation device to operate at the activation speed to fluidly seal the annular region.

12. The wellbore strengthening system of claim 11, wherein the one or more processors is further operable to request the annular isolation device to periodically form fluid seals of the annular region.

13. The wellbore strengthening system of claim 11, wherein the one or more processors is further operable to:

determine a desired intensity of the hydraulic pulse;

determine the activation speed of the annular isolation device that generates the desired intensity; and request the annular isolation device to operate at the activation speed to fluidly seal the annular region.

14. The wellbore strengthening system of claim 11, wherein the one or more processors is further operable to:

determine a wellbore property of the wellbore;

determine the activation speed of the annular isolation device based on the wellbore property of the wellbore; and request the annular isolation device to operate at the activation speed to fluidly seal the annular region.

15. The wellbore strengthening system of claim 11, further comprising a pressure valve configured to maintain pressure in the wellbore within a threshold pressure range.

16. The wellbore strengthening system of claim 11, wherein the annular isolation device is configured to engage a plurality of blades of the annular isolation device to extend radially outward to engage a wall of the wellbore and to fluidly seal the annular region.

17. The wellbore strengthening system of claim 11, wherein the annular isolation device is configured to expand an elastomeric seal to engage a wall of the wellbore and to fluidly seal the annular region.

* * * * *